US008820415B2

(12) United States Patent
Fay

(10) Patent No.: US 8,820,415 B2
(45) Date of Patent: Sep. 2, 2014

(54) SYSTEM FOR ENABLING SELECTIVE OPENING OF PORTS

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 543 days.

(21) Appl. No.: 13/211,644

(22) Filed: Aug. 17, 2011

(65) Prior Publication Data

US 2013/0043040 A1 Feb. 21, 2013

(51) Int. Cl.

| | |
|---|---|
| ***E21B 34/06*** | (2006.01) |
| ***E21B 34/00*** | (2006.01) |
| ***E21B 34/10*** | (2006.01) |
| ***E21B 34/14*** | (2006.01) |
| ***E21B 23/04*** | (2006.01) |

(52) U.S. Cl.

CPC ..... *E21B 23/04* (2013.01); *E21B 34/10* (2013.01); *E21B 34/14* (2013.01)

USPC ..... 166/373; 166/334.4

(58) Field of Classification Search

USPC ..... 166/334.4, 386, 319, 321, 373, 334.1, 166/316

See application file for complete search history.

(56) References Cited

U.S. PATENT DOCUMENTS

| | | | | |
|---|---|---|---|---|
| 4,771,831 | A * | 9/1988 | Pringle et al. | 166/319 |
| 6,286,594 | B1 * | 9/2001 | French | 166/151 |
| 6,352,119 | B1 * | 3/2002 | Patel | 166/386 |
| 6,394,184 | B2 | 5/2002 | Tolman et al. | |
| 6,431,277 | B1 | 8/2002 | Cox et al. | |
| 6,513,595 | B1 * | 2/2003 | Freiheit et al. | 166/332.4 |
| 6,520,255 | B2 | 2/2003 | Tolman et al. | |
| 6,543,538 | B2 | 4/2003 | Tolman et al. | |
| 6,550,541 | B2 * | 4/2003 | Patel | 166/386 |
| 6,575,247 | B2 | 6/2003 | Tolman et al. | |
| 6,672,405 | B2 | 1/2004 | Tolman et al. | |
| 6,915,856 | B2 | 7/2005 | Gentry et al. | |
| 6,957,701 | B2 | 10/2005 | Tolman et al. | |
| 7,059,407 | B2 | 6/2006 | Tolman et al. | |
| 7,357,151 | B2 | 4/2008 | Lonnes | |
| 7,467,778 | B2 | 12/2008 | Lonnes | |
| 7,516,792 | B2 | 4/2009 | Lonnes et al. | |
| 7,644,766 | B2 * | 1/2010 | Begley et al. | 166/312 |
| 7,726,406 | B2 | 6/2010 | Xu | |
| 8,267,178 | B1 * | 9/2012 | Sommers et al. | 166/334.4 |
| 8,276,675 | B2 * | 10/2012 | Williamson et al. | 166/383 |
| 8,291,982 | B2 * | 10/2012 | Murray et al. | 166/332.1 |
| 2003/0019630 | A1 * | 1/2003 | Freiheit et al. | 166/332.4 |
| 2005/0126787 | A1 | 6/2005 | Gomez | |

(Continued)

OTHER PUBLICATIONS

ZoneSelect MultiShift Frac Sliding Sleeve—Weatherford—Openhole Completions; pp. 1-4—dated Feb. 8, 2010.

*Primary Examiner* — Daniel P Stephenson

(74) *Attorney, Agent, or Firm* — Cantor Colburn LLP

(57) ABSTRACT

A system and method for selectively enabling fluid communication between two volumes includes a tubular having a port housing with at least one port and a member disposed with the tubular and movable between a closed position in which the port is closed and an open position in which the port is open. The system further includes a lock element positively engaged with both the member and the tubular for maintaining the member in the closed position. Further, an actuator is in keyed engagement with the lock element for biasing the lock element for enabling the member to move relative to the tubular to the open position for opening the port.

20 Claims, 6 Drawing Sheets

(56) References Cited

U.S. PATENT DOCUMENTS

2007/0007760 A1 1/2007 Stolle et al.
2009/0095486 A1* 4/2009 Williamson, Jr. ..... 166/373
2012/0031623 A1* 2/2012 Elrick et al. ..... 166/369
2012/0247767 A1* 10/2012 Themig et al. ..... 166/289
2013/0043040 A1* 2/2013 Fay ..... 166/373
2013/0299200 A1* 11/2013 Hughes et al. ..... 166/387

* cited by examiner

SYSTEM FOR ENABLING SELECTIVE OPENING OF PORTS

BACKGROUND

Selectively openable ports are used in the downhole drilling and completions industry for enabling fluid communication between tubulars, annuli, etc., in a variety of applications. Some systems use one or more slidable sleeves for providing the selective control of the ports. One way of increasing the pressure rating of the system is to increase the wall thickness of the components of the system. However, this can become very expensive and result in the need for a larger borehole or an unnecessarily large usage of radial space. As a result, the industry always well receives new port control systems having improved pressure ratings.

BRIEF DESCRIPTION

A system for selectively enabling fluid communication between two volumes, including a tubular having a port housing with at least one port; a member disposed with the tubular and movable between a closed position in which the port is closed and an open position in which the port is open; a lock element positively engaged with both the member and the tubular for maintaining the member in the closed position; and an actuator in keyed engagement with the lock element for biasing the lock element, wherein actuation of the actuator releases the lock element to resiliently spring into engagement with solely one of the member or the tubular for enabling the member to move relative to the tubular to the open position for opening the port.

A method of selectively enabling fluid communication between two volumes, including running a system having a member radially disposed with a tubular, the tubular having at least one port, the port closed when the member is in a closed position and open when the member is in an open position; maintaining the member in the closed position with a lock element positively engaged with both the member and the tubular, the lock element in keyed engagement with an actuator for biasing the lock element; pressurizing the system for actuating the actuator for releasing the lock element to resiliently spring into engagement with solely one of the member or the tubular for enabling relative movement between the member and the tubular; and depressurizing the system for moving the member to the open position to open the port.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
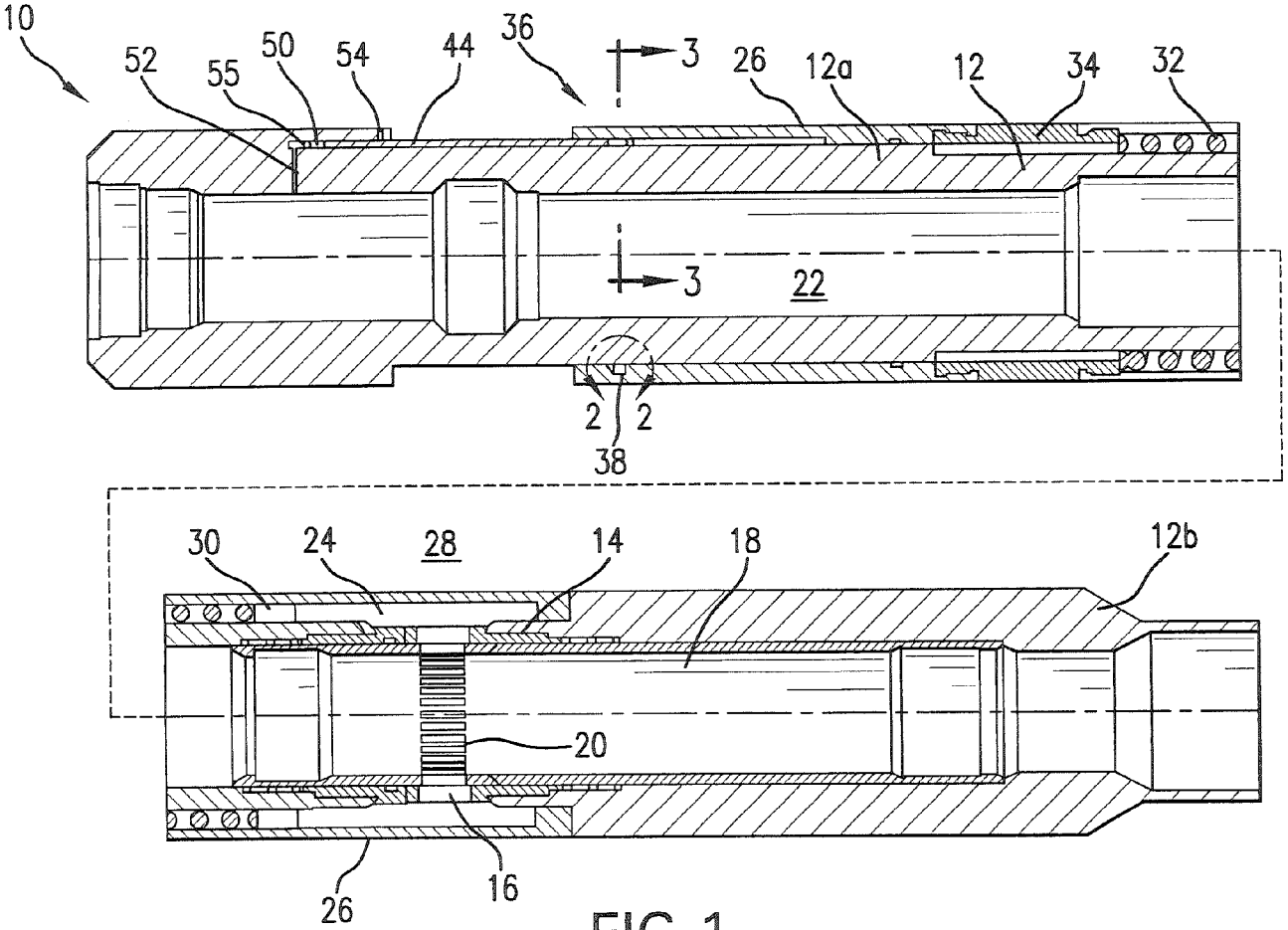
FIG. 1 is a cross-sectional view of a system for enabling selective fluid communication between opposite radial sides of a tubular in an initial run-in position.

Referring now to FIG. 1, a system 10 is shown including a tubular 12 formed, e.g., from a first sub 12*a* and a second sub 12*b*. The system 10 as illustrated in FIG. 1 is arranged for being initially run in a borehole or the like. In one embodiment, the first sub 12*a* is an upper sub and the second sub 12*b* is a lower sub. The system 10 includes a port housing 14 that is secured between the subs 12*a* and 12*b*. The housing 14 includes at least one opening or port 16 therein. An inner sleeve 18 is radially disposed within the tubular 12, having at least one opening or port 20 initially aligned with the port 16 in the coupling 14.

Initially, as shown in FIG. 1, the alignment of the ports 16 and 20 enable fluid communication between an interior passage 22 of the tubular 12 and a chamber 24 formed by an outer sleeve 26. As described in more detail below, the sleeve 26 is actuatable to release the ports 16 and 20 from the chamber 24 in order to enable fluid communication between the interior passage 22 and an outer volume 28 (e.g., a casing annulus) located radially outwardly of the system 10. Of course, other actuatable members such as valve mechanisms, rods, pistons, etc. could be used in lieu of the sleeves as disclosed herein for selectively opening ports. The ports 16 and 20 and the sleeve 26 are arranged, for example, to selectively enable fluid communication between a tubing and casing annulus in a downhole completion for providing fluid circulation therebetween, for providing high pressure fluid for fracturing a formation wall, etc. Also, for example, it is to be appreciated that the sleeve 26 could be any other actuatable member for opening a port or opening.

Figure 2:
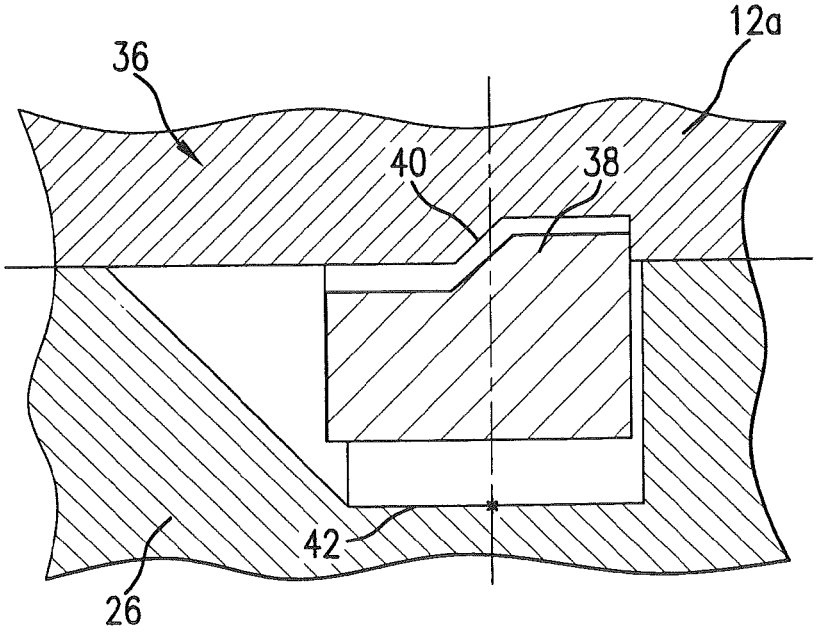
FIG. 2 is an enlarged view of the area encircled in FIG. 1.
Figure 3:
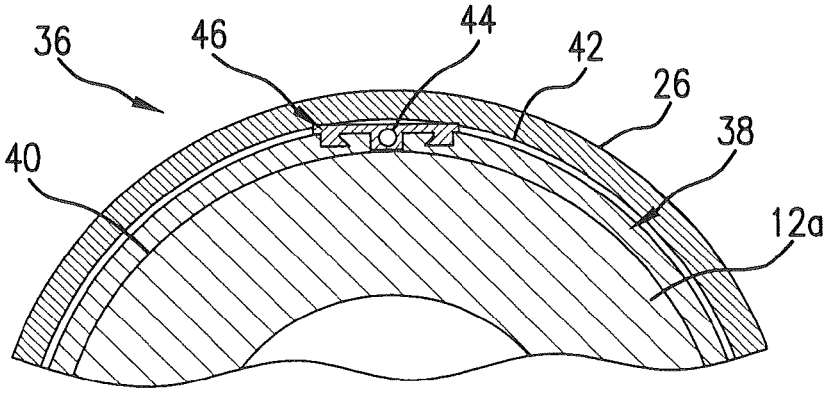
FIG. 3 is a cross-sectional view of a locking assembly of the system of FIG. 1 taken generally along line 3-3.

A retainer 30 is included affixed to the tubular 12 between the tubular 12 and the sleeve 26 for retaining a spring 32. The spring 32 urges a ring 34 of the sleeve 26 in a direction opposite the retainer 30. However, the sleeve 26 is initially locked by a locking assembly 36. The locking assembly includes a snap ring 38 disposed in both a groove 40 formed in the sub 12*a* and a groove 42 formed in the sleeve 26, as shown in more detail in FIG. 2. As shown in FIG. 3, a rod piston 44 includes a key member 46 engaged with both ends of the snap ring 38, which is formed as a substantially c-shaped ring. Locking both ends of the snap ring 38 with the key member 46 biases the snap ring 38 radially inwardly, as the snap ring 38 is arranged to expand radially outwardly or spring open in order to return to its neutral position. The snap ring 38 could take forms of other elements for providing a similar selective positive locking of the tubular 12 and sleeve 26, e.g., a leaf spring or other resilient or spring-like member, disposed in the grooves 40 and 42 and springing or expanding out of the groove 40 upon release from the key member 46. Further, the grooves 40 and 42 could be formed as notches or any other feature for enabling positive engagement of the snap ring 38 with the sleeve 26 and/or the tubular 12. Relative movement of the sleeve 26 with respect to the tubular 12 is prevented while the snap ring 38 is disposed in both the grooves 40 and 42, as the snap ring 38 causes positive interference between these components.

Figure 4:
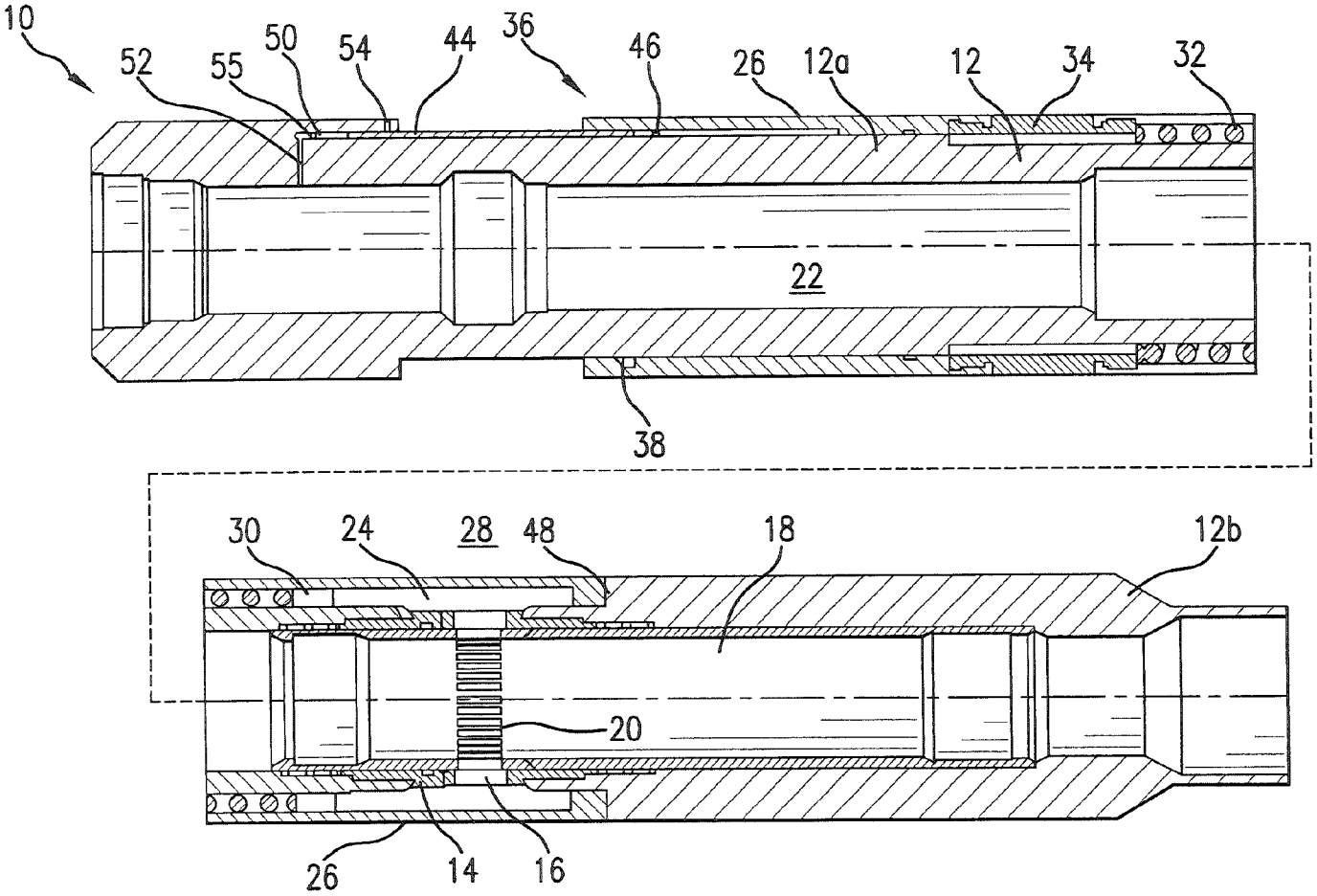
FIG. 4 is a cross-sectional view of the system of FIG. 1 under high tubing pressure for actuating a piston to release the locking assembly of FIG. 3.

By increasing the tubing pressure (i.e., pressurizing the interior passage 22), the sleeve 26 is urged against a stop 48 of the sub 12*b* due to pressure in the chamber 24. Simultaneously, a piston chamber 50 for the piston 44 is pressurized via a channel 52. Pressurizing the passage 22, and therefore the piston chamber 50, actuates the piston 44 toward the sub 12*b* as shown in FIG. 4. Actuation of the piston 44 moves the key member 46 axially out of engagement with the ends of the snap ring 38, thereby releasing the snap ring 38 to expand radially outwardly fully into the groove 42 and out of the groove 40. When released from the key member 46, the snap ring 38 is thus no longer locked in the groove 40 and accordingly no longer prevents relative movement between the sleeve 26 and the tubular 12. The groove 40 and snap ring 38 may include complementarily sloped surfaces for assisting in the tubular 12 expanding the snap ring 38 into the groove 42 when relative movement between the sleeve 26 and the tubular 12 begins. A release member 54, e.g., a set screw, could be included to prevent premature actuation of the piston 44, i.e., until a predetermined minimum pressure is reached in the chamber 50. A check valve 55 may also be included to hold the piston 44 in the actuated position once sufficient pressure has been introduced to the chamber 50.

Figure 5:
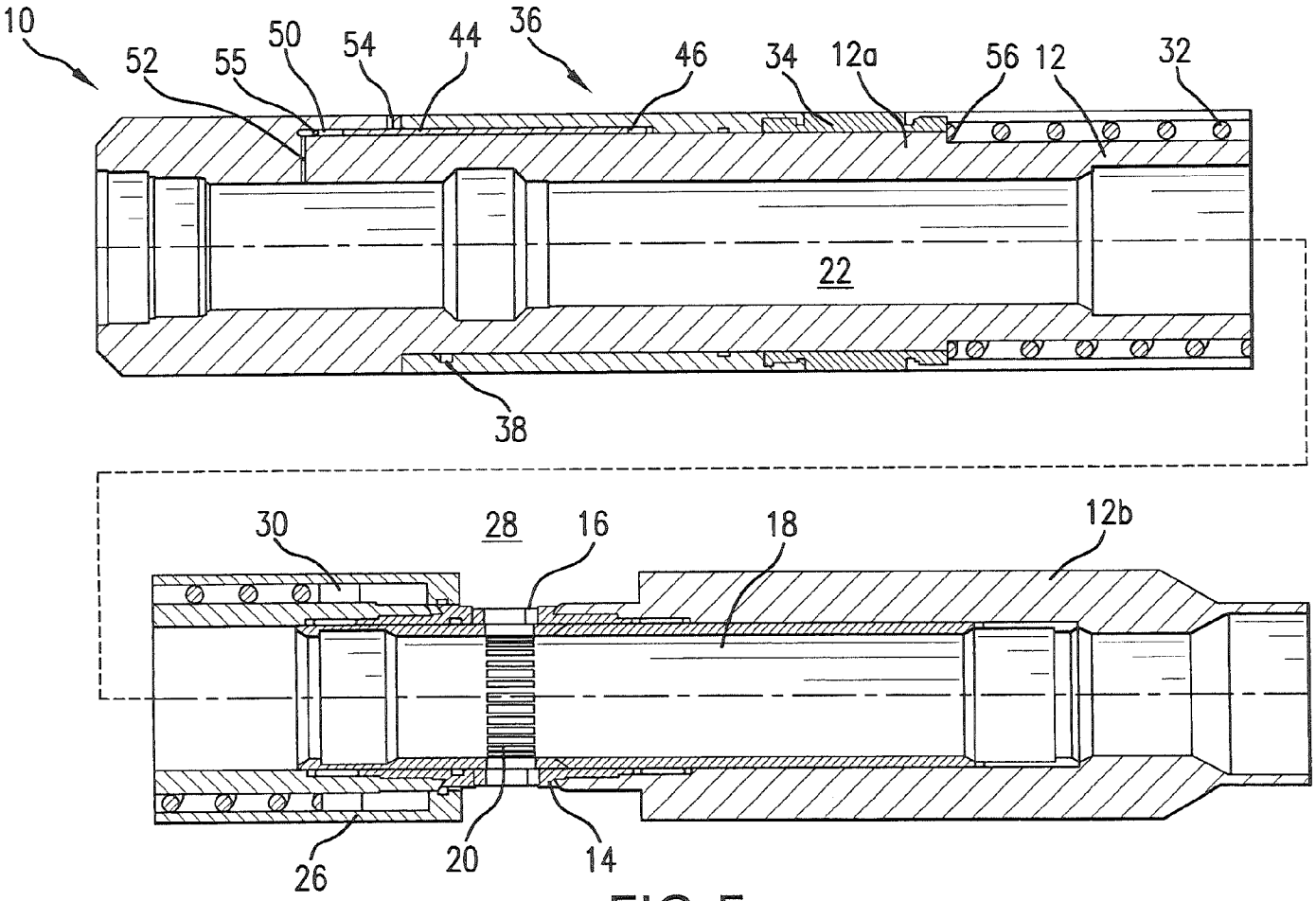
FIG. 5 is a cross-sectional view of the system of FIG. 4 after tubing pressure has been dropped for enabling actuation of an outer sleeve and fluid communication between an inner passage and outer volume via a set of ports.

When tubing pressure is dropped, as shown in FIG. 5, the sleeve 26, now released from the locking assembly 36 as discussed above, is urged by the spring 32 toward the sub 12*a*. The spring 32 shifts the sleeve 26 until the ring 34 travels in the axial direction past a stop 56 of the sub 12*a*. The stop 56 receives the spring 32 and prevents further movement of the sleeve 26. By shifting the sleeve 26, the ports 16 and 20 have become opened to the volume 28 for enabling fluid communication between the interior passage 22 and the volume 28. Of course, it is to be appreciated that the above-described components could be radially reversed but following a similar method, i.e., for enabling fluid communication between radially inner and outer volumes, but instead being actuated by the pressure in the outer volume. Further, it is to be noted that the unique arrangement of the currently described embodiments enables a higher pressure rating with respect to prior systems without the need to increase radial size.

Figure 6:
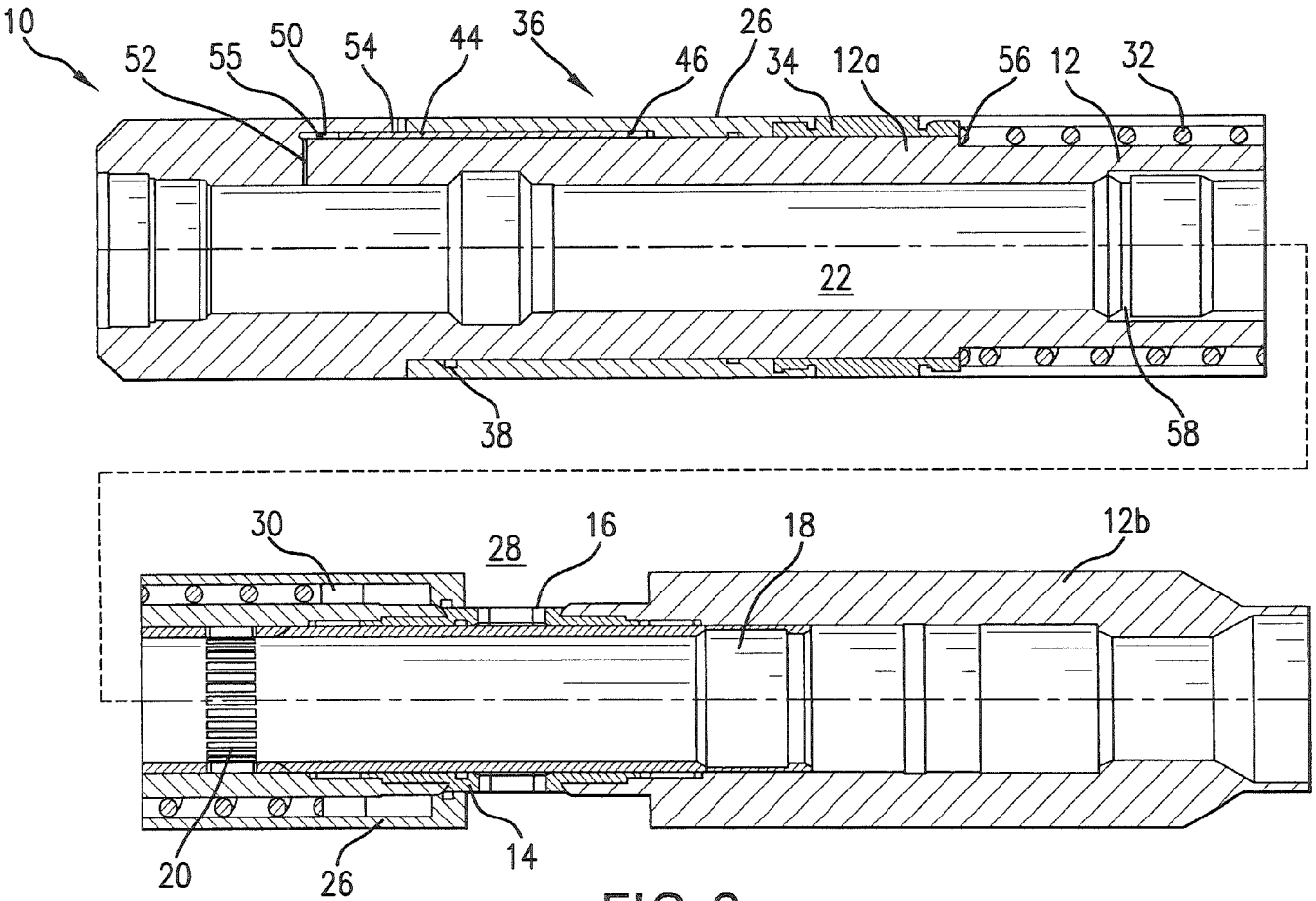
FIG. 6 is a cross-sectional view of the system of FIG. 5 in which an inner sleeve is shifted for selectively opening the ports after the outer sleeve has been actuated.

After actuation of the sleeve 26, the ports 16 and 20 can be selectively opened and closed by shifting the inner sleeve 18, as shown in FIG. 6. For example, the inner sleeve 18 includes a locking profile 58 for enabling shifting of the sleeve 18 by a standard shifting tool and wireline methods and equipment (not shown), which are well known in the art and require no further description.

Figure 7:
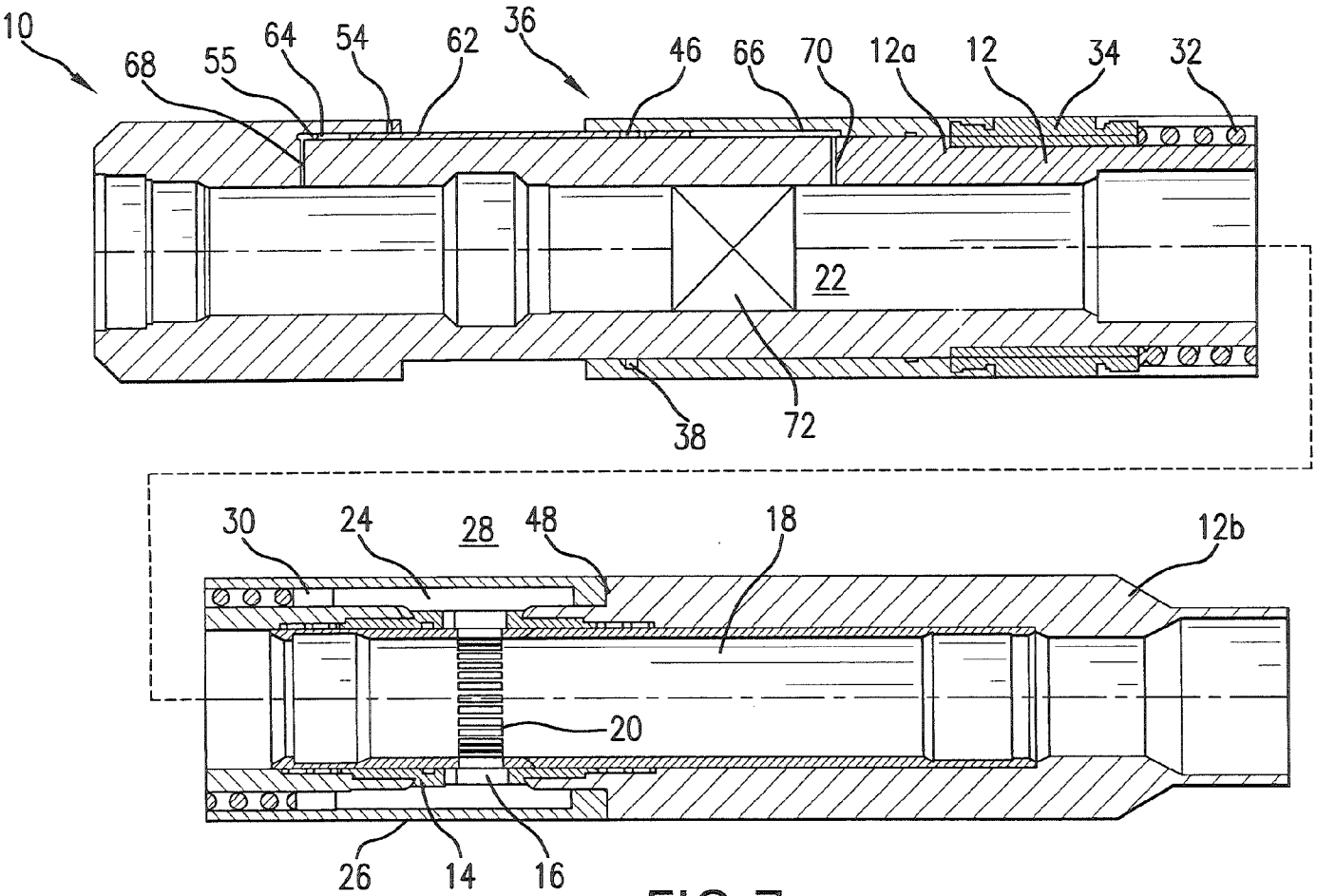
FIG. 7 is a cross-sectional view of a balanced piston embodiment requiring an isolation device to be set before ports can be opened.

Another embodiment is shown partially in FIG. 7. Specifically, a system 60 is shown including many of the same components as the system 10, which components are similarly numbered and included for the reasons discussed above. However, unlike the system 10, the system 60 is of a balanced piston design. That is, a balanced piston 62, in lieu of the piston 44, is associated with a first piston chamber 64 and a second piston chamber 66, the chambers 64 and 66 disposed at opposite ends of the piston 62. The piston chamber 64 is in communication with the passage 22 via a channel 68. The piston chamber 66 is in communication with the passage 22 via the channel 70. In another embodiment, the channel 70 could be formed axially between the chamber 66 and the chamber 24 (the retainer 30 positioned in the chamber 24 and not dynamically sealed to the sleeve 26, or including passages therethrough), with the chamber 24 open to the passage 22 via the ports 16 and 20, for achieving the same results.

Thus, by merely pressurizing the passage 22, a differential pressure will not be formed across the piston 62, as both chambers 64 and 66 are open to tubing pressure. If a differential pressure is not formed across the piston 62, the piston 62 will not actuate, thereby preventing the sleeve 26 from opening the passage 22 to the volume 28 via the ports 16 and 20. Accordingly, actuation of the piston 62 is only possible if isolation is first achieved between the chambers 64 and 66. In FIG. 7, an isolation device 72 is shown in the passage 22 for isolating the chambers 64 and 66 from each other. For example, the isolation device 72 could be a service packer sealing opposite ends from each other, a ball, plug, or dart landing in a seat for blocking the passage 22, or any other suitable means for isolating or sealing the chambers 64 and 66 from each other.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A system for selectively enabling fluid communication between two volumes, comprising:

a tubular having a port housing with at least one port;

a member disposed with the tubular and movable between a closed position in which the port is closed and an open position in which the port is open;

a chamber formed between the member and the tubular, the chamber in fluid communication with the port when the member is in the closed position but not when the member is in the open position;

a lock element positively engaged with both the member and the tubular for maintaining the member in the closed position; and an actuator in keyed engagement with the lock element for biasing the lock element, wherein actuation of the actuator releases the lock element to resiliently spring into engagement with solely one of the member or the tubular for enabling the member to move relative to the tubular to the open position for opening the port, wherein pressurizing the system simultaneously holds the member in the closed position and actuates the actuator for releasing the member.

2. The system of claim 1, wherein the member is a slidable sleeve.

3. The system of claim 1, wherein the lock element is a substantially c-shaped snap ring and the actuator includes a key engaged with opposite ends of the snap ring for biasing the snap ring.

4. The system of claim 1, wherein the lock member is initially disposed in both a first groove in the member and a second groove in the tubular, when released the lock member resiliently springing into solely one of the first or second grooves.

5. The system of claim 1, wherein the actuator is a piston.

6. The system of claim 5, wherein a tubing pressure in an interior chamber controls actuation of the actuator.

7. The system of claim 1, wherein moving the member to the open position enables fluid communication between an interior passage of the tubular and a volume located radially outside the tubular.

8. The system of claim 1, wherein the member is in fluid communication with the actuator when the member is in the closed position.

9. The system of claim 8, wherein depressurizing the system after pressurization automatically moves the member to the open position via a biasing member.

10. The system of claim 9, wherein the actuator comprises a balanced piston.

11. The system of claim 1, wherein fluid pressure isolation between the member and the actuator is required to actuate the actuator.

12. The system of claim 1, further including a second member, the second member disposed with the tubular radially opposite the member, wherein after the member is moved to the open position the second member is shiftable between a first position in which the port is open and a second position in which the port is closed.

13. The system of claim 1, wherein the member is urged toward the open position by a biasing member.

14. The system of claim 13, wherein releasing the lock element by actuating the actuator enables the biasing member to move the member into the open position.

15. The system of claim 13, wherein the biasing member is a spring.

16. A method of selectively enabling fluid communication between two volumes, comprising:

running a system having a member radially disposed with a tubular, the tubular having at least one port, the port closed when the member is in a closed position and open when the member is in an open position;

maintaining the member in the closed position with a lock element positively engaged with both the member and the tubular, the lock element in keyed engagement with an actuator for biasing the lock element;

pressurizing the system for actuating the actuator for releasing the lock element to resiliently spring into engagement with solely one of the member or the tubular for enabling relative movement between the member and the tubular; and depressurizing the system for moving the member to the open position to open the port.

17. The method of claim 16, further comprising isolating the member from the actuator before pressurizing the system.

18. The method of claim 16, wherein the lock element is initially engaged in both a first groove in the tubular and a second groove in the member, release of the lock element enabling the lock element to spring solely into one of the first or second grooves.

19. A system for selectively enabling fluid communication between two volumes, comprising:

a tubular having a port housing with at least one port;

a member disposed with the tubular and movable between a closed position in which the port is closed and an open position in which the port is open;

a lock element positively engaged with both the member and the tubular for maintaining the member in the closed position wherein the lock element is a substantially c-shaped snap ring; and an actuator in keyed engagement with opposite ends of the snap ring for biasing the snap ring, wherein actuation of the actuator releases the snap ring to resiliently spring into engagement with solely one of the member or the tubular for enabling the member to move relative to the tubular to the open position for opening the port.

20. A system for selectively enabling fluid communication between two volumes, comprising:

a tubular having a port housing with at least one port;

a member disposed with the tubular and movable between a closed position in which the port is closed and an open position in which the port is open;

a lock element positively engaged with both the member and the tubular for maintaining the member in the closed position; and an actuator, comprising a piston controlled by tubing pressure in an interior chamber, in keyed engagement with the lock element for biasing the lock element, wherein actuation of the actuator releases the lock element to resiliently spring into engagement with solely one of the member or the tubular for enabling the member to move relative to the tubular to the open position for opening the port.

* * * * *